US009068443B2

(12) United States Patent
Jefferies et al.

(10) Patent No.: US 9,068,443 B2
(45) Date of Patent: Jun. 30, 2015

(54) PLUNGER LIFT APPARATUS

(71) Applicant: EPIC LIFT SYSTEMS LLC, Fort Worth, TX (US)

(72) Inventors: James Allen Jefferies, Granbury, TX (US); Schuyler Kuykendall, Granbury, TX (US)

(73) Assignee: EPIC LIFT SYSTEMS LLC, Fort Worth, TX (US)

( * ) Notice: Subject to any disclaimer, the term of this patent is extended or adjusted under 35 U.S.C. 154(b) by 230 days.

(21) Appl. No.: 13/871,642

(22) Filed: Apr. 26, 2013

(65) Prior Publication Data

US 2014/0116714 A1 May 1, 2014

Related U.S. Application Data

(60) Provisional application No. 61/720,451, filed on Oct. 31, 2012.

(51) Int. Cl.
*E21B 43/12* (2006.01)
*E21B 34/14* (2006.01)

(52) U.S. Cl.
CPC ..... *E21B 43/12* (2013.01); *E21B 34/14* (2013.01); *E21B 43/121* (2013.01)

(58) Field of Classification Search
CPC ..... E21B 43/122; E21B 43/123
See application file for complete search history.

(56) References Cited

U.S. PATENT DOCUMENTS

| | | | |
|---|---|---|---|
| 1,932,992 | A | 10/1933 | Sherman et al. |
| 2,001,012 | A | 5/1935 | Burgher |
| 2,001,552 | A | 5/1935 | Scott |
| 2,013,111 | A | 9/1935 | Scott |
| 2,018,204 | A | 10/1935 | Evans et al. |
| 2,237,408 | A | 4/1941 | Burgher |
| 2,301,319 | A | 11/1942 | Peters |
| 2,539,000 | A | 1/1951 | Williams |
| 2,642,002 | A | 6/1953 | Knox et al. |
| 2,661,024 | A | 12/1953 | Knox |
| 2,676,547 | A | 4/1954 | Knox |
| 2,699,121 | A | 1/1955 | Knox |
| 2,714,855 | A | 8/1955 | Brown |
| 2,821,142 | A | 1/1958 | Knox |
| 2,878,754 | A | 3/1959 | McMurry |
| 2,884,861 | A | 5/1959 | Vincent et al. |
| 2,918,015 | A | 12/1959 | Knox |

(Continued)

FOREIGN PATENT DOCUMENTS

| | | | |
|---|---|---|---|
| RU | 2070278 | C1 | 12/1996 |
| SU | 63138 | A1 | 11/1943 |

(Continued)

OTHER PUBLICATIONS

Author Unknown, "Installing Plunger Lift Systems in Gas Wells", Lessons Learned from Natural Gas STAR Partners, United States Environmental Protection Agency, Oct. 2006, pp. 1-14.

(Continued)

*Primary Examiner* — William P Neuder

(74) *Attorney, Agent, or Firm* — MH2 Technology Law Group, LLP

(57) ABSTRACT

An improved bypass valve assembly for a plunger lift apparatus comprises a bypass valve cage having improved flow characteristics and a simplified clutch assembly having enhanced durability and low cost.

36 Claims, 4 Drawing Sheets

(56) References Cited

U.S. PATENT DOCUMENTS

| | | | | |
|---|---|---|---|---|
| 2,962,978 | A | 12/1960 | Reeves | |
| 2,970,547 | A | 2/1961 | McMurry | |
| 3,012,513 | A | 12/1961 | Knox | |
| 3,020,852 | A | 2/1962 | Roach et al. | |
| 3,031,971 | A | 5/1962 | Roach | |
| 3,090,315 | A | 5/1963 | Milton | |
| 3,095,819 | A | 7/1963 | Brown et al. | |
| 3,146,725 | A | 9/1964 | Harris | |
| 3,147,808 | A | 9/1964 | McCarvell et al. | |
| 3,329,211 | A | 7/1967 | Roach | |
| 3,473,611 | A | 10/1969 | Gregston | |
| 3,601,191 | A | 8/1971 | McMurray | |
| 3,827,491 | A | 8/1974 | Dinning | |
| 3,968,839 | A | 7/1976 | Swihart, Sr. | |
| 4,150,721 | A | 4/1979 | Norwood | |
| 4,211,279 | A | 7/1980 | Isaacks | |
| 4,352,376 | A | 10/1982 | Norwood | |
| 4,410,300 | A | 10/1983 | Yerian | |
| 4,417,858 | A | 11/1983 | Stout | |
| 4,451,209 | A | 5/1984 | Phillips | |
| 4,502,843 | A | 3/1985 | Martin | |
| 4,596,516 | A | 6/1986 | Scott et al. | |
| 4,889,473 | A | 12/1989 | Krueger | |
| 4,898,235 | A | 2/1990 | Enright | |
| 4,921,048 | A | 5/1990 | Crow et al. | |
| 4,923,372 | A | 5/1990 | Ferguson et al. | |
| 5,132,904 | A | 7/1992 | Lamp | |
| 5,146,991 | A | 9/1992 | Rogers, Jr. | |
| 5,253,713 | A | 10/1993 | Gregg et al. | |
| 5,427,504 | A | 6/1995 | Dinning et al. | |
| 5,551,512 | A | 9/1996 | Smith | |
| 5,984,013 | A | 11/1999 | Giacomino et al. | |
| 6,041,874 | A | 3/2000 | Lee | |
| 6,045,335 | A | 4/2000 | Dinning | |
| 6,059,040 | A | 5/2000 | Levitan et al. | |
| 6,148,923 | A | 11/2000 | Casey | |
| 6,176,309 | B1 | 1/2001 | Bender | |
| 6,209,637 | B1 | 4/2001 | Wells | |
| 6,467,541 | B1 | 10/2002 | Wells | |
| 6,644,399 | B2 | 11/2003 | Abbott et al. | |
| 6,688,385 | B1 | 2/2004 | Moe | |
| 6,719,060 | B1 | 4/2004 | Wells | |
| 7,128,170 | B1 | 10/2006 | Russell et al. | |
| 7,270,187 | B2 | 9/2007 | Shulyatikov et al. | |
| 7,383,878 | B1 | 6/2008 | Victor | |
| 7,438,125 | B2 | 10/2008 | Victor | |
| 7,669,651 | B1 | 3/2010 | Carstensen | |
| 8,181,706 | B2 | 5/2012 | Tanton | |
| 8,464,798 | B2 | 6/2013 | Nadkrynechny | |
| 8,627,892 | B2 | 1/2014 | Nadkrynechny | |
| 2003/0155117 | A1 | 8/2003 | Gray et al. | |
| 2004/0026085 | A1 | 2/2004 | Vacik et al. | |
| 2004/0168832 | A1 | 9/2004 | Russell et al. | |
| 2005/0161212 | A1* | 7/2005 | Leismer et al. | 166/179 |
| 2005/0178543 | A1 | 8/2005 | Giacomino | |
| 2005/0230119 | A1 | 10/2005 | McGarian et al. | |
| 2005/0230120 | A1 | 10/2005 | Victor | |
| 2005/0241819 | A1* | 11/2005 | Victor | 166/68 |
| 2005/0274527 | A1 | 12/2005 | Misselbrook et al. | |
| 2006/0024928 | A1* | 2/2006 | Seebauer et al. | 438/514 |
| 2006/0054329 | A1 | 3/2006 | Chisholm | |
| 2006/0185853 | A1 | 8/2006 | Bender | |
| 2007/0267189 | A1 | 11/2007 | Wells | |
| 2009/0020293 | A1 | 1/2009 | Richards | |
| 2010/0294507 | A1 | 11/2010 | Tanton | |

FOREIGN PATENT DOCUMENTS

| | | | |
|---|---|---|---|
| SU | 171351 | A1 | 1/1965 |
| SU | 182634 | A1 | 1/1966 |

OTHER PUBLICATIONS

E. Beauregard et al., "Introduction to Plunger Lift: Application, Advantages and Limitations", Presented at the Southwestern Petroleum Short Course Department of Petroleum Engineering Texas Tech University, Lubbock, Texas, Apr. 23-24, 1981, pp. 1-10.

Dan Phillips et al., "Plunger lift with wellhead compression boosts gas well production", World Oil, Oct. 1986, pp. 96-100.

Dan Phillips et al., "How to optimize production from plunger lift systems", World Oil, Apr. 1998, pp. 110-120.

Dan Phillips et al., "How to optimize production from plunger lift systems", World Oil, May 1998, pp. 67-72.

A.A. Popov, "Experience in Introducing Plunger Lift at Fields of the Ukhta Complex", Gazovoe delo, No. 9, 1968, pp. 23-26.

I. Shulyatikov et al., "Removing Liquid from Gas Wells by Well Shuttles", Corrosion & Prevention—2001, Sep. 29-Oct. 2, 2002, pp. 1-7.

James Lea et al., "Gas Well Dequalification Solutions to Gas Well Liquid Loading Problems", Gulf Drilling Guides, 2003, pp. 1-321.

James Lea et al., "Gas Well Dequalification Second Edition", Gulf Drilling Guides, 2008, pp. 1-605.

G.V. Chilingarian et al., "Surface operations in petroleum production, I", Developments in Petroleum Science, 19A, 1987, pp. 466-476, 515-517, and 529-530.

Author Unknown, Plunger Lift Systems, NOV Monoflo, 2013, pp. 1-8.

Arie Janssens et al., Clinton Sandstone Papers, Presented at the Ohio Oil and Gas Association Winter Meetings 1961 to 1978, Abridged Reprint, 1985, pp. 1-215.

Author Unknown, "How to Make More Production with Plunger Lift", Harbison-Fischer Opti-Miser Well Controll System, Developing Unconventional Gas Technical Workshop, Mar. 29, 2010, pp. 1-29.

David Cosby, P.E., "Introduction to Plunger Lift", Gas Well Dequalification Workshop, Feb. 24-26, 2014, pp. 1-43.

Divyakumar O. Garg, B.E., "New Modeling Techniques for Two-Piece Plunger Lift Components", A Thesis in Petroleum Engineering, Texas Tech University, Dec. 2004, pp. 1-103.

Author Unknown, Subsurface Equipment—Plungers, Ferguson Beauregard, web page, http://www.fbdover.com/products/plungers/subsurface-equipment, accessed Mar. 27, 2014, 1 page.

Author Unknown, Shuttle Ball Plunger, Pro-Seal Lift Systems, 2013, http://prosealinc.com/plunger-lift/shuttle-ball-plunger/, accessed Feb. 21, 2014, 1 page.

Author Unknown, Bypass Plungers, Pro-Seal Lift Systems, 2013, http://prosealinc.com/plunger-lift/bypass-vs-non-bypass/, accessed Feb. 21, 2014, 1 page.

Author Unknown, "Which plunger is right for my well?", Shale Tec, LLC, 2014, http://www.shaletec.com/faq/which-plunger-is-right-for-my-well/, accessed Feb. 21, 2014, pp. 1-4.

Shulyatikov et al., "Improved Technology of Removing Liquid from Wells of Gas and Gas-Condensate Fields at Declining Production Period by Flying Valves", 22nd World Gas Conference, 2003, pp. 1-4.

G.I. Zadora, "Gas Production Operator", Recommended by the Central Scientific and Methodological Office of the Ministry of Gas Industry as a Textbook to Train and Develop Industry Personnel, Moscow, Nedra, 1980, pp. 1-10 (including translation).

Lufkin; "Plunger Lift Systems, International Lift Systems"; website products brochure; 28 pages; copyright 2011; www.lufkin.com.

* cited by examiner

PLUNGER LIFT APPARATUS

RELATED APPLICATIONS

The present application claims priority to U.S. Provisional Patent Application Ser. No. 61/720,451 filed Oct. 31, 2012 by the same inventors and entitled PLUNGER LIFT APPARATUS.

BACKGROUND OF THE INVENTION

1. Field of the Invention

The present invention generally relates to oil and gas production operations, and more particularly to gas-lift plunger devices for lifting production fluids to the surface to restore production to shut in wells.

2. Description of the Prior Art

Gas lift plunger apparatus has been in use for many decades and has a long history of development. In one recent example, U.S. Pat. No. 7,438,125, Victor, a bypass assembly of a plunger lift device employs a bypass valve assembly having both an internal cage and an outer cage. The internal cage, when rotated using an adjustment performed with tools at the surface, operates to vary the size of the bypass orifices of the bypass valve and thus vary the bypass fluid volume. In addition a clutch within the lower part of the outer cage is used to maintain the valve push rod in a fixed position within the valve assembly until the push rod is forced to change the valve from an open (bypass) configuration to a closed (no bypass) configuration. The clutch tension is provided by a plurality of small metal coil springs wrapped around the clutch bobbin that surrounds the push rod. Some disadvantages of this design are its complexity that increases its cost and the effects of corrosion which predisposes the clutch assembly to premature failure. Another drawback is that the bypass orifices are cut at right angles through the inner and outer cages, which impedes the flow of fluid through the plunger as it descends through the tubing.

In another example, U.S. Patent Application Publication No. 2010/0294507, Tanton (See also U.S. Pat. No. 6,467,541, Wells) discloses two different free piston embodiments in which one or both of their components are made of materials that are at least partly buoyant. One embodiment is a simple combination of a sleeve having a seat to receive a ball at its lower end, as in a ball-check valve. In operation the ball is allowed to fall through the fluid in the well bore, followed by the sleeve at some time interval. The ball reaches the bottom of the well first. When the sleeve arrives it contacts the ball, which seals the well bore. Gas pressure can then lift the ball and sleeve together to the surface, pushing the production fluid ahead of them upward through the well bore. The other embodiment eliminates the separate ball or plug and closes the lower end of the sleeve, thus presenting a closed face to whatever material is in the well casing during descent. While simple in configuration, the first lacks predictability because the sleeve and ball operate independently until they reach the bottom of the well bore, and the second lacks broad utility because of its buoyancy and is not able to bypass fluids as it descends to the bottom of the well.

Variations in the ball-check valve concept have been in the art for decades, as for example is illustrated in U.S. Pat. No. 2,001,012 patented May 14, 1935.

What is needed is an improved plunger bypass valve mechanism for a gas lift plunger device that is simple and durable, as well as reliable in operation and low in cost to manufacture.

SUMMARY OF THE INVENTION

It is an object of the present invention to provide a clutch assembly for a plunger lift bypass valve having an axial valve stem slidingly disposed within a valve cage attached to a plunger lift, the clutch assembly comprising a split bobbin sized to surround less than 360 degrees of the perimeter of the valve stem; a resilient tension band formed of synthetic rubber and surrounding the split bobbin; and a predetermined surface roughness applied to the valve stem. In another aspect the tension band may be configured as two or more tension bands used together.

In another embodiment there is provided an improved bypass valve assembly for a plunger lift apparatus, comprising a bypass valve cage with at least one elongated opening or port formed through a side wall of the bypass valve cage, the opening outwardly relieved at a lower end thereof; a valve stem disposed within a longitudinal bore of the valve cage and having a predetermined surface roughness; and a split bobbin clutch assembly including a resilient tension band formed of a synthetic rubber having an A Scale durometer characteristic between 60 and 90, the clutch assembly disposed around the valve stem.

In yet another embodiment of the invention there is provided a plunger lift apparatus having an improved bypass valve assembly, comprising a plunger body having a plurality of annular sealing rings and a full diameter upper body portion with shortened taper at an upper end thereof, the plunger body configured at a lower end thereof for threadable engagement with the bypass valve assembly; and a bypass valve assembly comprising a valve cage and a valve stem having a clutch assembly disposed there around, the valve stem disposed within a longitudinal bore of the valve cage, the clutch assembly configured as a split bobbin having a synthetic rubber or elastomer tension band disposed around the split bobbin, and the valve stem surface configured with a predetermined surface roughness.

DETAILED DESCRIPTION OF THE INVENTION

Figure 1:
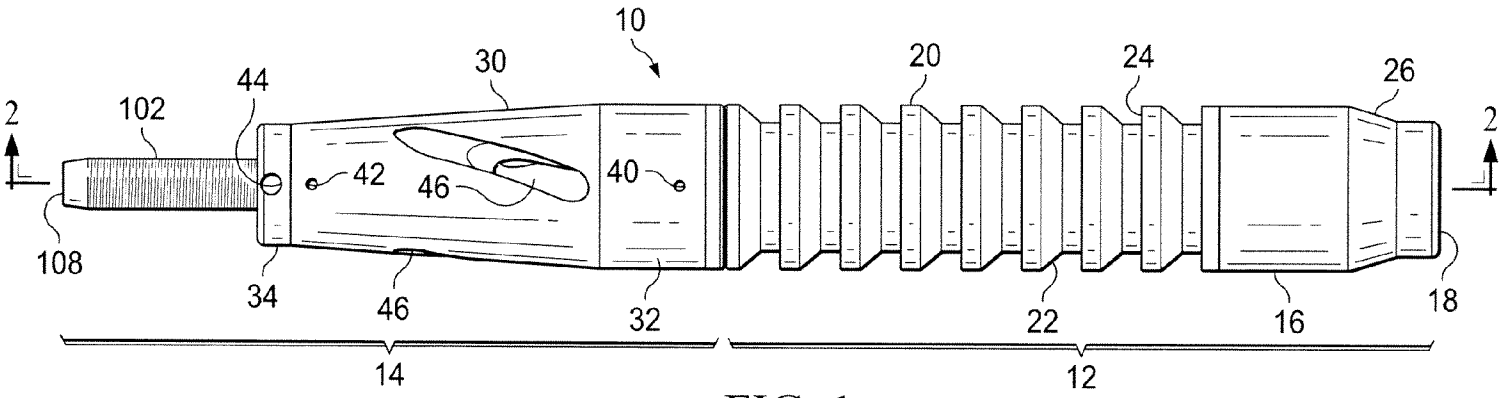
FIG. 1 illustrates a perspective view of one embodiment of a plunger lift apparatus—a rotary bypass plunger—according to the present invention.

The drawings that accompany the following description depict several views of a bypass valve assembly for a gas lift plunger apparatus according to one embodiment of the rotary bypass plunger apparatus provided by the present invention. It has been discovered that significant improvements can be made to the bypass valve assembly that utilizes a clutch-controlled "dart" or valve stem that reciprocates within a bypass valve "cage" and provides a mechanism for sealing the fluid passages through the bypass valve. One of the functions of the bypass valve is to allow fluid to flow through the valve in a controlled manner to control descent of the plunger assembly to the bottom of the well. Another function of the bypass valve assembly is to switch the valve configuration to seal the passages that allow the flow-through of fluid so that the plunger acts as a piston to seal the well bore and permit the gas pressure in the well to force the piston and accumulated fluids above it to the surface so that production from the well can resume.

The present invention incorporates design features that substantially improve the performance and durability of the bypass valve assembly in a gas lift plunger. Descent of the plunger assembly is faster and better controlled, which cuts the shut-in time approximately in half, thus more quickly restoring the well to production. Moreover, the superiority of the valve stem and clutch assembly configuration that is disclosed herein, which enables the switch from plunger bypass/descent to gas lift/ascent at the bottom of the well, is confirmed by performance in the field. The success of the improved design of the present invention is demonstrated by sales volume exceeding 1200 units during the first six months of its availability, without a single reported instance of failure. In addition, the reliability and durability of the plunger and the bypass valve assembly is extended by the features to be described herein, thereby reducing downtime and maintenance costs.

To achieve the aforementioned advantages, the following features are preferably and most advantageously used in combination in the bypass valve assembly described herein: (a) elongated bypass openings or ports that are relieved at the upper and lower ends at an angle to reduce turbulence and improve flow as the plunger descends, providing a smoother and a more rapid descent; (b) helical disposition of the bypass openings around the body of the bypass valve assembly to impart a torque to the plunger, causing it to spin within the well casing as it descends, ensuring more uniform wear and longer life while providing a smoother descent; (c) a valve stem clutch with an elastomeric tension band (or bands) that is more resistant to high temperatures and corrosive chemicals than metal and thus much less prone to failure; (d) calibrated surface roughness of the valve stem surface to improve the friction characteristics of the valve stem clutch as it arrives at the bottom of the well and configures the plunger for its ascent to the surface; (e) machined grooves on the inner surface of the clutch bobbin to allow sand particles to be flushed away from within the clutch, thereby preventing undesired lock-up; and (f) shortened taper of the upper end of the plunger body that utilizes the improved bypass valve assembly, to ensure a more complete seal with minimum leakage of production fluids during ascent of the plunger to the surface.

Variations in the above features are contemplated to adapt the bypass valve assembly to different well circumstances. For example, the number of bypass openings or slots may be varied to provide different flow rates. The tension in the tension band (or bands) of the clutch assembly may be varied or adjusted to adapt the clutch clamping force to different descent velocities as the plunger contacts the bumper at the well bottom. The helical pitch may be varied within narrow limits to control the amount of spin imparted to the plunger. The profile of the machined grooves in the clutch bobbin may be varied to accommodate different sand particle sizes. The surface roughness of the valve stem may be varied to optimize the friction applied by the clutch. The tapered profile of the plunger body at the upper end may be varied to optimize ascending performance with different fluid viscosities, etc. Persons skilled in the art will understand that the bypass valve assembly described herein—the assembly of the cage, valve stem and clutch—may be constructed in a variety of combinations of the above features and interchanged with other combinations to suit particular conditions of individual oil or gas wells. For example, the plunger and bypass valve assembly may be produced in several diameters for use in different size well tubing. Also, different length plungers may be provided. For example, a shorter bypass plunger is better able to negotiate well tubing that have curves or elbows, and because of its lower weight, it places less stress on the bumper spring at the bottom in wells that are relatively dry. A longer casing falls more easily through more fluid and provides a better sealing action. This adaptability is yet another advantage of the present invention. As is well known, performance of a gas lift plunger may be reduced if the configuration of the plunger is not well-matched to the conditions of a particular well.

One important component of the clutch assembly to be described herein is the elastomer tension band. In this description the use of the singular form of the term "tension band" is intended to mean that the tension band may be composed of one such band or a plurality of individual bands used together. The tension band (or bands) may be fabricated of an elastomeric material, a broad category of synthesized polymer materials that are commonly known as synthetic rubber. Among the properties required in the tension band is resistance to high temperatures and corrosion, elasticity, reversibility—ability to return to and maintain its unstressed or relaxed configuration after being stressed, and excellent stability. Some examples of such materials include neoprene, buna-N, respectively polychloroprene and acrylonitrile butadiene. An alternative is hydrogenated nitrile rubber. Another example, preferred for the present invention, is a fluoroelastomer such as a fluoronated hydrocarbon better known as Viton®, a registered trademark of the E. I. DuPont de Nemours and Company or its affiliates of Wilmington, Del., USA. In particular, the preferred material will have a Shore A durometer of 60 to 90, and for most applications a Shore durometer of 75 on the A scale is preferred. In some applications where the tension band needs to be thicker or wider (greater cross sectional area), the durometer figure may be reduced. Similarly, if the tension band needs to be thinner or narrower (lesser cross sectional area), the durometer figure should be increased.

When installed on the valve stem, the split bobbin segments are disposed around the valve stem shaft, held in a clamping action against the valve stem shaft by the action of the elastomer tension band. The elastomer tension band has been found during tests to provide superior durability in down-hole conditions to other ways such as metal springs to provide the needed clamping force. The clamping force provided by the tension band resists by friction of the bobbin segment against the valve stem the movement of the valve stem through the clutch assembly. This friction arises because of the clamping force from the tension band and the predetermined surface roughness formed into the surface of the valve stem shaft along the greater portion of its length. The function of the clutch assembly is to ensure that the valve stem remains in either (a) the lower-most position within the valve cage during descent of the plunger so that the plunger will fall freely through the fluid in the well casing and cause it to rotate smoothly during the descent; and (b) the upper-most position within the valve cage during ascent of the plunger to seal the bypass valve assembly so that the gas pressure in the well will cause the plunger to rise through the well casing, pushing the production ahead of it. The clutch assembly enables the valve stem to be held in the appropriate position during descent and ascent, and also to change the position of the valve stem from the lower-most position to the upper-most position when the plunger reaches the bottom of the well to configure the plunger for its ascent.

In the drawings to be described each structural feature is identified with a reference number. A feature bearing the same reference number in more than one figure may be assumed to be the same feature. Turning now to FIG. 1 there is illustrated a perspective view of one embodiment of a plunger lift apparatus—a rotary bypass plunger—according to the present invention. The plunger 10 includes two main sections—the plunger section 12 and the rotary bypass valve assembly 14. The plunger section 12 includes the plunger body 16 having an upper end 18, a series of concentric outer rings 20 and a tapered portion 26. The outer rings 20 around the plunger section 12 provide a seal against the well casing (not shown) and reduce friction (because of reduced surface area of the plunger section 12) as the plunger 10 descends or ascends through the well casing. The sloped surface 22 on the upper side of each ring facilitates ascent by reducing friction due to turbulence of the fluid. The underside 24 of the outer rings 20 may optionally be configured to serve a purpose such as minimizing drag, improving sealing, providing a flushing action upon descent, etc. In some applications the outer rings 20 may be formed as a continuous helix instead of concentric rings, for example.

The rotary bypass valve assembly 14 (also: bypass valve 14) includes a valve cage 30, an end cap 34, and a valve stem 102. The body 32 of the valve cage 30 may be threaded (See FIG. 2) onto the lower end of the body 16 at threads 41 and may be secured with a set screw in a threaded hole 40. The end cap 34 may be similarly threaded (See FIG. 2) into the lower end of the valve cage 30 at threads 43 and may also be secured with a set screw in a threaded hole 42. An optional socket 44 for a spanner wrench for removing the bypass valve assembly 14 and the end cap 34 is shown in the outer surface of the end cap 34. The valve cage 30 includes bypass ports 46, to be further described below, which are disposed at equal radial intervals around the valve cage 30.

Figure 2:
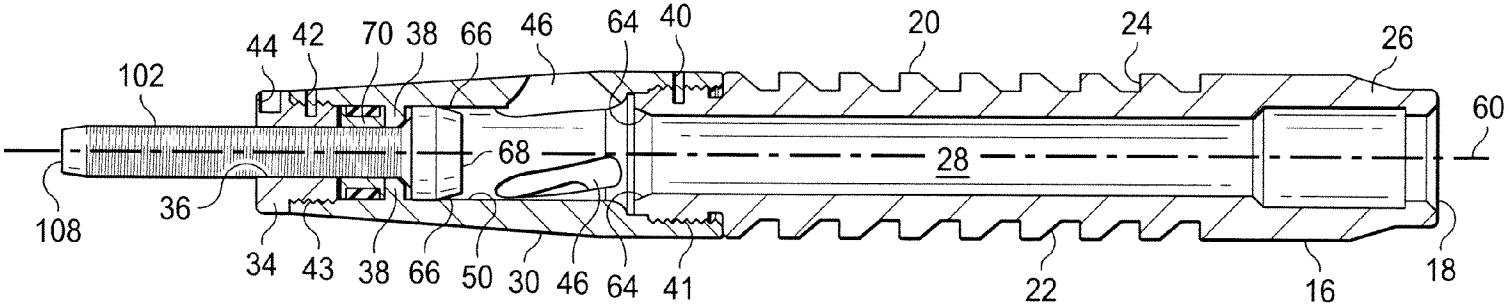
FIG. 2 illustrates a cross section view along a longitudinal axis of the embodiment of FIG. 1.

FIG. 2 illustrates a cross section view along a longitudinal axis 60 of the embodiment of FIG. 1. FIG. 2 is a side cross section view of the assembled bypass plunger 10 showing the sealing rings 20 formed along the axis 60 of the bypass plunger 10. The bypass valve assembly 14 is shown to the left in the figure, and the upper end 18 of the plunger body 16 having the shortened taper 26 is shown at the right in the figure. The shortened taper 26 permits the upper portion of the plunger body 16 of the bypass plunger 10 to retain its full diameter over a maximum portion—at least 70% thereof—of its length. This feature provides improved sealing performance as the bypass plunger 10 rises within the well bore while lifting the production fluids to the surface. The plunger body 16 of the plunger section 12 is hollow—formed with a cylindrical bore 28 in this example to permit the flow of fluid through it during descent of the bypass plunger 10. During descent, fluid flow enters the lower end of the bypass plunger 10 through the bypass ports 46 and the cylindrical bore 50 in the bypass valve cage 30, and through the cylindrical bore 28 of the plunger body 16. FIG. 2 also depicts a cross section view of the valve stem 102 with the clutch assembly 70 installed including the split bobbin 72 and the elastomer tension band 76 disposed around the split bobbin 72, as these components appear when assembled in the bypass valve cage 30. The clutch assembly 70 is further described in FIGS. 5, 6, and 7.

Also clearly visible in FIGS. 1 and 2 is the bypass valve assembly 14. As shown in the cross section view of FIG. 2, the bypass valve assembly 14 includes the valve stem 102 disposed within a bore 36 through the end cap 34, a clutch assembly 70 encircling the valve stem 102, and an elongated bypass port 46. Three such ports 46 are depicted in the preferred embodiment shown in the drawings, although for example without limitation other embodiments may include two or four such ports 46. The details of the port 46 will be described in FIGS. 3A through 3C. The profile of the ports 46 features relieved areas to facilitate the flow of fluids during descent of the bypass plunger 10. This relieved port configuration provides less resistance and turbulence to the flow of fluids as the bypass plunger 10 falls through the well bore. The valve stem 102 includes an enlarged head 68 at its upper end that includes a chamfered perimeter 66 formed to mate with a similarly beveled seat 64 formed in the lower end of the bore 28 through the plunger body 16. This configuration provides a poppet-type valve to regulate the flow of fluid through it. The poppet valve configuration thus provides for sealing the bypass valve assembly 14 against the passage of fluids as the plunger 10 ascends through the well casing.

Continuing with FIG. 2, the clutch assembly 70 to be described maintains the valve stem 102 in an extended, open-valve position during the descent of the bypass plunger 10. The clutch assembly 70 is held in place in the lower end of the bypass valve cage 30 between a circumferential internal ridge 38 and the end cap 34. When the plunger 10 reaches the bottom as the lower end of the valve stem 102 contacts a bumper at the well bottom, the inertia of the plunger 10 overcomes the frictional clamping force of the clutch assembly 70, enabling the valve stem 102 to move upward (to the right in the figure) through the bore 50 in the bypass valve cage 30 and against the seat 64 in the plunger body 16 to seal the bypass valve assembly 14. Thus sealed, the bypass plunger 10 functions like a piston, allowing the gas pressure in the well to lift the bypass plunger 10 upward, carrying accumulated fluids above it to the well surface.

Preferred materials for fabricating the rotary bypass plunger 10 described herein include the use of type 416 heat treated stainless steel for the bypass valve stem 102 and the clutch bobbin segments 72A/72B. The remaining parts—plunger body 16, valve cage 30, and end cap 34 may be fabricated of type 4140 heat treated alloy steel. In alternative embodiments, the 416 heat treated stainless steel may be used to fabricate all of these parts. Both materials are readily available as solid "rounds" in a variety of diameters, as is well known in the art.

Figure 3A:
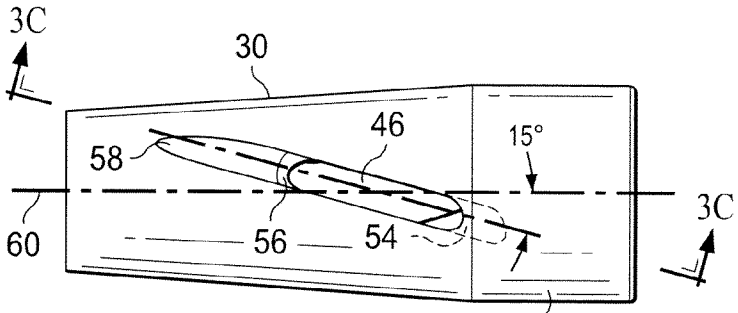
FIG. 3A illustrates a side view of an embodiment of a bypass valve cage portion of the embodiment of FIGS. 1 and 2.
Figure 3B:
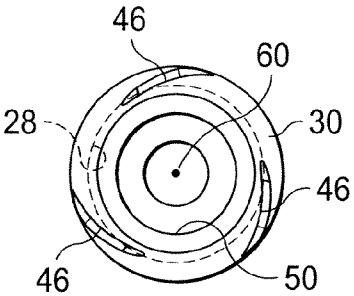
FIG. 3B illustrates an end view of the embodiment depicted in FIG. 3A.
Figure 3C:
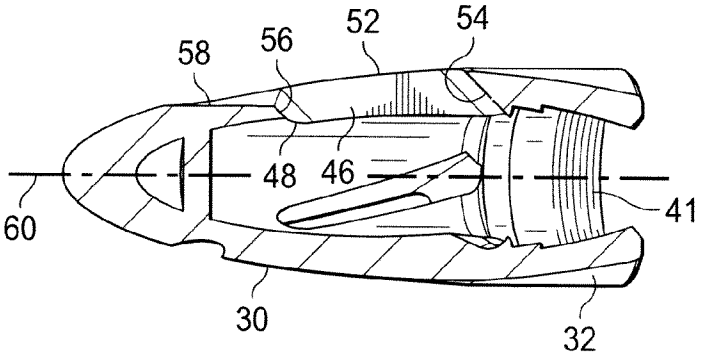
FIG. 3C illustrates a cross section view of the embodiment of FIGS. 3A and 3B along the line 3C-3C as shown.

FIGS. 3A, 3B, and 3C illustrate a bypass valve cage 30 of the present invention in several views to depict the profile of a bypass port 46. The actual shape of the bypass port 46 is somewhat complex because of the tapered cylinder or conical configuration of the body 32 of the valve cage 30 and the helical alignment of a port 46 around the valve cage 30. The views in FIGS. 3A and 3C illustrate the basic parameters of the profile of the port 46. The port 46 is an elongated slot with rounded ends 54, 56 cut through the wall of the body 32 of the valve cage 30. As will be described, the port 46 may be substantially aligned with a continuous helix disposed around the tapered cylinder valve cage 30. In addition, both ends 54, 56 of the port 46 are cut at the same angle of approximately (but not limited to) 45° in the illustrated embodiment with the centerline 60 of the valve cage 30 as shown in FIG. 3C.

This nominal 45° angle results in an inward slope of the ends 54, 56 of the port 46 with both ends 54, 56 oriented toward the upper end 18 of the bypass plunger 10 as it is positioned within a well casing. This relief of the ends 54, 56 of the port 46 facilitates the flow of fluid through the port(s) 46 as the bypass plunger 10 falls through the well casing by gravity. In alternate embodiments, this nominal angle of 45° may be varied to suit a particular implementation of the bypass valve assembly 14. For example, the angle may be different at opposite ends of the port(s) 46, they may be larger or smaller acute angles relative to the longitudinal axis 60, the angled surfaces may be rounded in profile for even smoother flow through the port(s) 46, etc. An additional relieved area, called ramp 58, further smooths the path for fluid flow at the lower end 54 of each port 46.

The surface of the ramp 58 shown in FIGS. 3A and 3C may be a flat or curved feature that is substantially parallel with the centerline or axis 60 of the valve cage 30 and, because of the conical outer shape of the valve cage 30 in the illustrated embodiment, forms an angle 52 of approximately 7° with the outer surface of the valve cage 30. This angle 52 may typically vary from about 5° to 10° depending on the particular dimensions of the valve cage, but may be subject to other angles beyond this relatively small range in alternative embodiments. Persons skilled in the art will recognize that a variety of modifications to this port profile may be made to accommodate particular circumstances of manufacturing or application in the field, without departing substantially from the purpose of the profile shown in FIGS. 3A and 3C. The essential concept is to relieve the passage through which fluids are to flow by removing sharp angles, etc. to provide a smooth, obstruction-free passage. As a result, the plunger descends more rapidly and more predictably than conventional plunger designs.

Continuing with FIG. 3A, the port 46 is also oriented at a small angle relative to the length of the bypass plunger 10. To illustrate, the length of the port 46 forms an angle of approximately 15° with respect to the axis 60 if the position of the port 46 is projected on to the plane of the centerline or axis 60 of the bypass plunger 10. Thus, this angle may be substantially in alignment with a helical path around the body or wall 32 of the valve cage 30. Orienting a port 46 in this way will cause the plunger 10 to rotate or spin as it descends within the well casing because the fluid flow through the angled port 46 exerts a torque on the plunger 10. Further, to balance the effect of the helical orientation of the port 46, the port 46 is preferably disposed at two, three, or four locations around the valve cage 30 and separated at uniform radial intervals around the body 32 of the valve cage 30. The use of two or more ports 46 spaced at uniform intervals around the body 32 of the valve cage 30 also facilitates the passage of fluid through the plunger as it descends through the well tubing. FIG. 3B depicts a view of the lower end of the valve cage 30 to show the appearance of the valve cage 30 with three of the helically-oriented ports 46 disposed at even intervals around the body 32 of the valve cage 30. The benefits of the helical orientation of the several, evenly separated ports 46 is to facilitate rotation of the bypass plunger 10 and provide a smooth descent and uniform wear of the bypass plunger 10, thus extending its useful life through many gas lift cycles.

Figure 4:
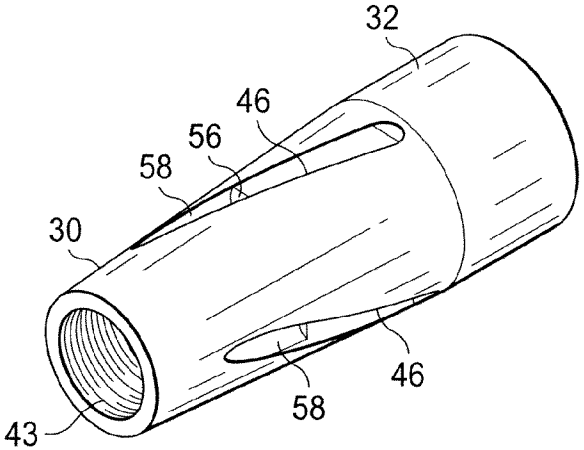
FIG. 4 provides a perspective view of a bypass valve cage 30 as it may appear in one embodiment of the present invention.

The combination of the helical orientation of the ports 46, preferably disposed at several uniform radial positions around the body of the valve cage 30, each having the relieved ends 54, 56, 58, provides a rotary gas lift plunger that outperforms known bypass plungers by providing smoother, faster descent along with more uniform wear and extended life in the field. FIG. 4 provides a perspective view of a bypass valve cage 30 showing the appearance of two of the ports 46 when disposed at three evenly separated positions—120° apart—around the body 32 of the valve cage 30.

Figure 6:
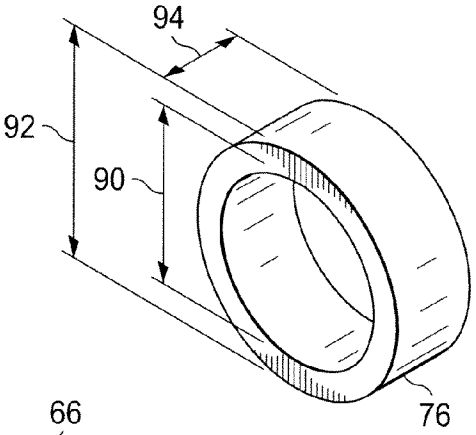
FIG. 6 illustrates a perspective view of a resilient tension band for use in the clutch assembly embodiment depicted in FIG. 5.
Figure 5:
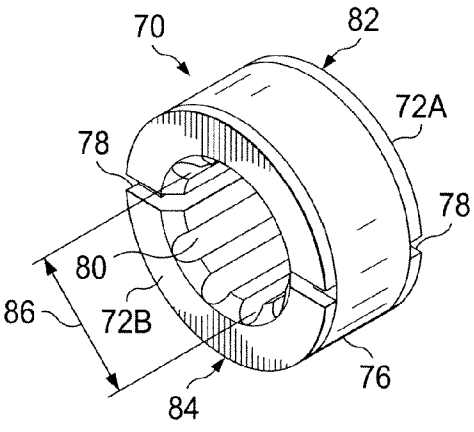
FIG. 5 illustrates a perspective view of one embodiment of a clutch assembly used in the rotary bypass plunger according to the present invention.
Figure 7:
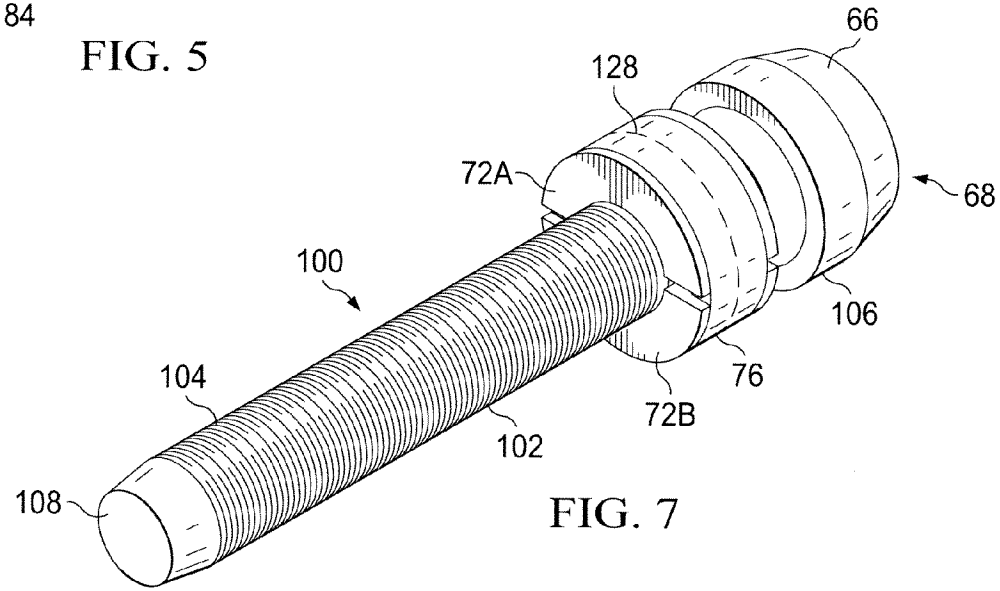
FIG. 7 illustrates a perspective view of a bypass valve stem and clutch assembly for use in the embodiment of FIGS. 1 through 5 of the present invention.

FIGS. 5, 6, and 7 illustrate perspective views of one embodiment of a clutch assembly 70 used in the rotary bypass plunger 10 according to the present invention. In FIG. 5 the clutch assembly 70 includes a split bobbin 72 that surrounds the valve stem 102. The split bobbin 72 is held in place by a tension band 76 that is placed around the two segments 72A, 72B of the split bobbin 72, and within the space defined by the first and second rims 82, 84 of the bobbin segments 72A, 72B, thus clamping the bobbin segments 72A, 72B against the outer surface of the valve stem 102. The bobbin segments 72A, 72B are identical in this illustrated embodiment, each one 8 resembling a semicircle except for being slightly shortened from a full 180° by the gap 78, which 9 may be provided by making a 0.063 to 0.125 inch saw cut, for example, through the diameter of a single formed circular bobbin 72. In other embodiments, the bobbin may be split into three or more segments, although two segments are adequate for this purpose and somewhat simpler to manufacture and handle during assembly. The split bobbin 72 illustrated in FIG. 5 is shown with the segments 72A and 72B separated by the amount of the gap 78 even though the bobbin 72 is not 14 installed on a valve stem 102. When installed on the valve stem 102, the gap 78 may typically be reduced under the effect of the tension band 76.

Continuing with FIG. 5, the tension band 76 is made of a resilient material and is configured to tightly press the bobbin segments 72A, 72B against the outer surface 104 of the valve stem 102. In the present embodiment the inside diameter 86 of each half 72A, 72B of the split bobbin 72 is the substantially the same as the outside diameter of the valve stem 102 but is formed as slightly less than a full semicircle because of the small gap 78 provided between the proximate ends of the split bobbin 72 when it is in place around the valve stem 102. This enables the inner surface of the bobbin halves 72A, 72B to fully contact the valve stem 102 to provide maximum friction to resist the movement of the valve stem 102 through the clutch assembly 70 except when the plunger 10 contacts the bottom of the well bore during a gas lift operation.

Also depicted in FIG. 5 is an additional feature of the split bobbin 72, the series of grooves 80 formed on the inner surfaces of the split bobbin 72. These grooves, preferably uniformly disposed around the circumference of the bobbin segments 72A, 72B, provide passages for fluids to flush particles of sand away from the contact area of the bobbin 72 with the outer surface of the valve stem 102. The grooves 80 may be formed by machining or swaging, for example. In the illustrated example, four such grooves 80 are formed in each bobbin segment 72A, 72B, although the number may be varied, generally between two and six grooves 80 in each segment may be practical. However, the greater the number of grooves in the split bobbin 72, the more the grooves 80 will be limited to trapping most grains rather than allowing them to be flushed out of the clutch assembly 70.

FIG. 6 illustrates a perspective view of a resilient tension band 76 for use in the clutch assembly 70 embodiment depicted in FIG. 4. The tension band 76, which is formed as a ring having an inside diameter 90 about the same as or slightly smaller than the outer diameter of the central portion of the assembled split bobbin 72A/72B and an outside diameter 92 slightly less than the outer diameter of the rims 82, 84 of the split bobbin 72A/72B, which in turn is only slightly less than the inner bore 50 of the valve cage 30 just below the internal ridge 38. The tension band 76 preferably has a width 94 dimensioned to fill the full width between the first and second rims 82, 84 of the split bobbin 72A/72B. It can further be seen that the resilient tension band 76, which has a rectangular cross section to fit within the rims 82, 84 of the split bobbin 72, acts to form a very compact clutch assembly 70. This configuration exerts a constant clamping force around the valve stem 102. It has been found that the clamping force exerted by the elastomer tension band 76 does not diminish significantly over a great many gas lift cycles.

Moreover, the synthetic rubber material used in the tension band 76 is essentially impervious to the corrosive effects of most of the materials in the fluids found in oil and gas wells. These properties are unlike the use of small diameter coil springs, for example, which, being made of metal, are susceptible to such corrosion. Such corrosion requires additional maintenance—and down time—to replace and restore the tension of the springs or other metal components used to provide the necessary tension in the clutch 70. The tension band 76 is preferably fabricated of a synthetic rubber material having a durometer of between 60 and 90 on the Shore "A" Scale. This requirement provides for sufficient tension when the tension band 76 is stretched over the rims 82, 84 of the split bobbin 72 to secure the clutch assembly 70 around the valve stem 102. In the embodiments described herein, the clutch assembly 70 is designed to resist a linear pull on the valve stem 102 of approximately 2.8 to 3.6 lbs in this example, although adjustments to the tension may generally vary from 1.0 to 6.0 lbs. in other examples but are not so limited because some applications mat require the clutch to satisfy clamping forces beyond this range. The performance of the clutch assembly 70 is also dependent on the finish applied to the valve stem 102, as will be described with FIG. 7.

Suitable materials for the tension band 76 for the clutch assembly 70 include neoprene and buna-N, respectively polychloroprene and acrylonitrile butadiene. An alternative is hydrogenated nitrile rubber. Another example, preferred for the present invention, is a fluoroelastomer such as a fluoronated hydrocarbon better known as Viton®, a registered trademark of the E. I. DuPont de Nemours and Company or its affiliates of Wilmington, Del., USA. In particular, the preferred material will have a Shore A durometer of 60 to 90, and for most applications a Shore durometer of 75 on the A scale has been found to work the best.

FIG. 7 illustrates a perspective view of the assembly 100 of a bypass valve stem 102 and clutch assembly 70 for use in the embodiment of FIGS. 1 through 6 of the present invention. FIG. 7 also includes the details of the finish required on the surface 104 of the stem portion of the valve stem 102 that provides a surface roughness between 500 and 550 micro inches. This figure of 500 to 550 microinches describes the tolerance in the surface finish between the peak and valley portions of the roughened surface. In the illustrated embodiment the roughness of the surface 104 of valve stem 102 may be provided by a shallow continuous groove inscribed helically along the outer surface 104 of the portion of the valve stem 102 that is disposed within the clutch assembly 70. The net effect of the clamping force provided by the tension band 76 combined with the surface roughness provided by the inscribed grooves 104 is to resist a pull on the lower end 108 of the valve stem 102 within the range of one to six lb. In one preferred embodiment the level of pull is set within the range of 2.8 to 3.6 lb. This surface roughness 104 thus forms an integral component of the friction effect of the clutch assembly 70 when it is installed on the valve stem 102, improving its effectiveness and consistency.

Figure 9:
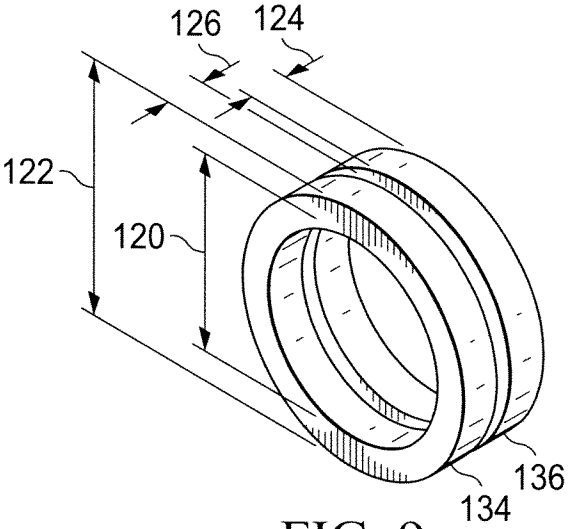
FIG. 9 illustrates a perspective view of a resilient tension band for use in the clutch assembly embodiment depicted in FIG. 8.
Figure 8:
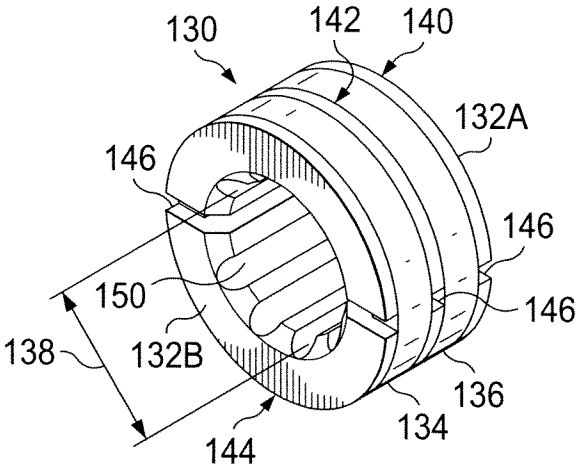
FIG. 8 illustrates a perspective view of an alternate embodiment of a clutch assembly used in the rotary bypass plunger according to the present invention.

FIGS. 8 and 9 depict an alternate embodiment 130 of the clutch assembly 70 that is shown in FIGS. 5 and 6. Clutch assembly 130 may be used interchangeably with clutch assembly 70. The clutch assembly 70 uses a single tension band 76, whereas the clutch assembly 130 uses two tension bands and a split bobbin assembly 132 comprised of segments 132A/132B that has an additional rim 142 surrounding the bobbin. FIG. 8 thus illustrates a clutch assembly 130 that includes a split bobbin 132 that surrounds the valve stem 102. The split bobbin 132 is held in place by a pair of tension bands 134/136 that are placed around the two segments 132A, 132B of the split bobbin 132, and within the space defined by the first and second rims 140 and 142, and 144 and 142 of the bobbin segments 132A, 132B, thus clamping the bobbin segments 132A, 132B against the outer surface of the valve stem 102. The bobbin segments 132A, 132B are identical in this illustrated embodiment, each one resembling a semicircle except for being slightly shortened from a full 180° by the gap 146, which may be provided by making a 0.063 to 0.125 inch saw cut, for example, through the diameter of a single formed circular bobbin 132.

In other embodiments, the bobbin may be lengthened to cover a greater portion of the valve stem 102. Further, the bobbin may be split into three or more segments (not shown), although two segments are adequate for this purpose and somewhat simpler to manufacture and handle during assembly. The split bobbin 130 illustrated in FIG. 8 is shown with the segments 132A and 132B separated by the amount of the gap 146 even though the bobbin 130 is not installed on a valve stem 102. When installed on the valve stem 102, the gap 146 may typically be reduced under the effect of the pair of tension bands 134 and 136 used together. In other similar embodiments, the number of tension bands such as the tension bands 134, 136 may exceed two, an intermediate rim or rimes such as the rim 142 may or may not be used or needed, and the bobbin 132 may be split into more than two segments. In some embodiments the tension bands may simply be ordinary O-rings, such as those that are made of Viton®, as described herein above, which may be selected for size, thickness, or durometer to enable adjustment of the clamping force of the clutch assembly. Two or more such O-rings may be used to provide a particular adjustment to the tension—weaker or stringer—exerted on the bobbin segments of the clutch assembly.

Continuing with FIG. 8, the tension bands 134, 136 may be made of a resilient material and is configured to tightly press the bobbin segments 132A, 132B against the outer surface 104 of the valve stem 102. In the present embodiment the inside diameter 138 of each half 132A, 132B of the split bobbin 132 is the substantially the same as the outside diameter of the valve stem 102 but is formed as slightly less than a full semicircle because of the small gap 146 provided between the proximate ends of the split bobbin 132 when it is in place around the valve stem 102. This enables the inner surface of the bobbin halves 132A, 132B to fully contact the valve stem 102 to provide maximum friction to resist the movement of the valve stem 102 through the clutch assembly 130 except when the plunger 10 contacts the bottom of the well bore during a gas lift operation.

Also depicted in FIG. 8 is an additional feature of the split bobbin 132, the series of grooves 150 formed on the inner surfaces of the split bobbin 132. These grooves, preferably uniformly disposed around the circumference of the bobbin segments 132A, 132B, provide passages for fluids to flush particles of sand away from the contact area of the bobbin 132 with the outer surface of the valve stem 102. The grooves 150 may be formed by machining or swaging, for example. In the illustrated example, four such grooves 150 are formed in each bobbin segment 132A, 132B, although the number may be varied, generally between two and six grooves 150 in each segment may be practical. However, the greater the number of grooves in the split bobbin 132, the more the grooves 150 will be limited to trapping most grains rather than allowing them to be flushed out of the clutch assembly 130.

FIG. 9 illustrates a perspective view of a pair of resilient tension bands 134, 136 for use in the clutch assembly 130 embodiment depicted in FIG. 8. The use of two or more tension bands instead of one may be preferred in some applications. For example, when it is necessary to provide a clutch assembly such as clutch assembly 70 or 130 to increase the effective clamping surface area against the valve stem 102, the split bobbin may be lengthened along the longitudinal axis to accommodate additional tension bands. In the example illustrated in FIGS. 8 and 9, the tension bands 134, 136, may each be formed as a ring having an inside diameter 120 about the same as or slightly smaller than the outer diameter of the central portion of the assembled split bobbin 132A/132B and an outside diameter 122 approximately the same (as shown in FIGS. 7 and 8) slightly less than the outer diameter of the rims 140, 142, 144 of the split bobbin 132A/132B, which in turn may only be slightly less than the inner bore 50 of the valve cage 30 just below the internal ridge 38. The tension bands 134, 136 preferably each have a width 124, 126 dimensioned to fill the width between the first and second rims 140, 142 and 142, 144 respectively of the split bobbin 132A/132B. It can further be seen that the resilient tension bands 134, 136, which may have a rectangular cross section to fit within the respective rims 140, 142, 144 of the split bobbin 132, act to form a very compact clutch assembly 130. Alternately, the intermediate rim 142 may be deleted and a pair of tension bands placed side-by-side around the split bobbin as indicated by the dashed line 128 encircling the tension band 76 depicted in FIG. 7. Either of these configurations exerts a constant clamping force around the valve stem 102. It has been found that the clamping force exerted by the elastomer tension bands 134, 136 do not diminish significantly over a great many gas lift cycles.

The materials suitable for the tension bands 134, 136 in FIGS. 8 and 9, or other embodiments thereof, are as described in FIG. 5 herein above. That is, the tension bands 134, 136 are preferably fabricated of a synthetic rubber material having a durometer of between 60 and 90 on the Shore "A" Scale. This requirement provides for sufficient tension when the tension bands 134, 136 are stretched over the rims 140, 142, 144 of the split bobbin 132 to secure the clutch assembly 130 around the valve stem 102. In the embodiments described herein, the clutch assembly 130 is designed to resist a linear pull on the valve stem 102 of approximately 2.8 to 3.6 lb. in this example. Adjustments to the tension may generally vary from 1.0 to 6.0 lb. in other examples but are not so limited because some applications may require the clutch to satisfy clamping forces beyond this range as mentioned herein. The performance of the clutch assemblies 70, 130 are also dependent on the finish applied to the valve stem 102, as previously described with FIG. 7.

Returning now to FIGS. 1 and 2, the bypass valve assembly 14 may be assembled by first installing the valve stem 102 into the larger end of the valve cage 30 until it seats against the internal ridge 38 within the bore of the valve cage 30. The valve cage may then be screwed onto the lower end of the plunger body 12 and secured with a set screw in the threaded hole 40. Next, the clutch assembly 70 is installed over the lower end 108 of the valve stem 102 until it is seated against the opposite side of the internal ridge 38 within the valve cage 30, followed by threading the end cap 34 into the lower end of the valve cage 30 to secure the clutch assembly 70 within the valve cage 30. The end cap 34 may be tightened to a specified torque with the aid of a spanner wrench (not shown as it does not form part of the invention) inserted into the socket 38, and secured using a set screw installed in the threaded hole 42.

While the invention has been shown in only one of its forms, it is not thus limited but is susceptible to various changes and modifications without departing from the spirit thereof.

What is claimed is:

1. A clutch assembly for a plunger lift bypass valve, comprising:

a split bobbin configured to be disposed around at least a portion of a valve stem of the plunger lift bypass valve; and at least one tension band surrounding the split bobbin and configured to press the split bobbin into engagement with the valve stem, wherein the split bobbin defines one or more grooves in an inner surface thereof, the one or more grooves at least partially defining a fluid flowpath between the split bobbin and the valve stem when the inner surface of the split bobbin engages the valve stem.

2. The clutch assembly of claim 1, wherein the split bobbin comprises a plurality of circular ring segments that are movable relative to one another.

3. The clutch assembly of claim 2, wherein a first one of the plurality of circular ring segments comprises a first circumferential end and a second one of the plurality of circular ring segments comprises a second circumferential end, wherein the first and second circumferential ends are spaced apart and define a first gap therebetween when the split bobbin is disposed around the valve stem.

4. A bypass valve assembly for a plunger lift apparatus, comprising:

a bypass valve cage defining a bore;

a valve stem disposed at least partially through the bore of the valve cage; and a split bobbin clutch assembly including a split bobbin surrounded by at least one tension band, wherein the split bobbin clutch assembly is disposed around the valve stem and is coupled with the valve cage, and wherein the tension band presses the split bobbin into engagement with the valve stem, wherein the valve cage comprises a sidewall defining a first and second openings therethrough, and wherein the first opening defines a ramp extending at an acute angle to a longitudinal axis of the valve cage.

5. The clutch assembly of claim 1, wherein the at least one tension band comprises a resilient material.

6. The clutch assembly of claim 1, wherein the at least one tension band comprises at least two tension bands spaced axially apart from one another along the split bobbin.

7. The clutch assembly of claim 1, wherein the at least one tension band comprises an elastomer that is selected from the group consisting of hydrogenated nitrile rubber, polychloroprene, a fluoroelastomer, and acrylonitrile butadiene.

8. The clutch assembly of claim 1, wherein the split bobbin comprises a rim disposed on a radially outer surface of the split bobbin, the at least one tension band being retained in an axial direction by the rim.

9. A bypass valve assembly for a plunger lift apparatus, comprising:

a bypass valve cage defining a bore;

a valve stem disposed at least partially through the bore of the valve cage; and a split bobbin clutch assembly including a split bobbin surrounded by at least one tension band, wherein the split bobbin clutch assembly is disposed around the valve stem and is coupled with the valve cage, and wherein the tension band presses the split bobbin into engagement with the valve stem, wherein an outer surface of the valve stem defines a groove inscribed at least partially around the valve stem and extending axially along at least a portion of a length of the valve stem, wherein the split bobbin engages the outer surface proximal to the groove.

10. The bypass valve assembly of claim 9, further comprising a valve cage cap coupled with an end of the valve cage, wherein the valve cage cap and the valve cage retain the split bobbin clutch assembly.

11. The bypass valve assembly of claim 9, wherein the valve cage comprises a sidewall defining first and second openings therethrough.

12. The bypass valve assembly of claim 11, wherein the valve cage defines a plurality of openings including at least the first opening and the second opening, wherein the plurality of openings are disposed at substantially equal intervals around the valve cage.

13. The bypass valve assembly of claim 9, wherein the split bobbin comprises a plurality of circular ring segments that are movable relative to one another.

14. The bypass valve assembly of claim 13, wherein the plurality of circular ring segments each define a radius of curvature that is substantially equal to a radius of an outer surface of the valve stem.

15. The bypass valve assembly of claim 9, wherein the at least one tension band comprises at least two tension bands spaced axially apart along the split bobbin.

16. The bypass valve assembly of claim 9, wherein the at least one tension band comprises an elastomer that is selected from the group consisting of hydrogenated nitrile rubber, polychloroprene, a fluoroelastomer, and acrylonitrile butadiene.

17. The bypass valve assembly of claim 9, wherein the groove is substantially helical.

18. A bypass valve assembly for a plunger lift apparatus, comprising:

a bypass valve cage defining a bore;

a valve stem disposed at least partially through the bore of the valve cage; and a split bobbin clutch assembly including a split bobbin surrounded by at least one tension band, wherein the split bobbin clutch assembly is disposed around the valve stem and is coupled with the valve cage, and wherein the tension band presses the split bobbin into engagement with the valve stem, wherein the valve cage comprises a sidewall defining first and second openings therethrough, and wherein the first and second openings each extend along a helical path around the valve cage.

19. The bypass valve assembly of claim 18, wherein at least a portion of an outer surface of the valve stem has a predetermined surface roughness of 500 to 550 micro inches, and wherein the split bobbin engages the outer surface.

20. The bypass valve assembly of claim 18, wherein the helical path defines a helix angle of approximately 15 degrees.

21. A plunger lift apparatus, comprising:

a plunger body defining a flow passage therethrough; and a bypass valve assembly coupled with the plunger body and in fluid communication with the flow passage, the bypass valve assembly comprising a valve cage defining a bore, a valve stem, and a clutch assembly disposed at least partially around the valve stem and retained in the valve cage, the valve stem being disposed at least partially within the bore of the valve cage, wherein the clutch assembly comprises a split bobbin and at least one tension band disposed around the split bobbin, and wherein the tension band presses the split bobbin into engagement with the valve stem, and wherein the valve stem defines a groove inscribed at least partially around the valve stem and along at least a portion of a length of the valve stem, wherein the split bobbin engages the valve stem proximal to the groove.

22. The plunger lift apparatus of claim 21, wherein the valve cage defines a first opening and a second opening through a wall of the valve cage, and wherein the first opening and the second opening are configured to fluidly communicate with the flow passage defined in the plunger body.

23. The plunger lift apparatus of claim 22, further comprising a plurality of openings including at least the first and second openings, wherein the plurality of openings are separated apart at generally uniform intervals around the valve cage.

24. The plunger lift apparatus of claim 21, wherein the split bobbin comprises a plurality of circular segments that are moveable one relative to the other.

25. The plunger lift apparatus of claim 21, wherein the at least one tension band comprises a resilient material.

26. The plunger lift apparatus of claim 21, wherein the at least one tension band comprises at least two tension bands spaced axially apart along the split bobbin.

27. The bypass valve assembly of claim 21, wherein the at least one tension band comprises an elastomer that is selected from the group consisting of hydrogenated nitrile rubber, polychloroprene, a fluoroelastomer, and acrylonitrile butadiene.

28. The plunger lift apparatus of claim 21, wherein:

the plunger body comprises an upper body portion comprising a full-diameter section and a tapered section extending upwards from the full diameter portion, the upper body portion being positioned proximal to an upper end of the plunger body; and the plunger body further comprises a plurality of annular sealing rings encircling the plunger body.

29. The plunger lift apparatus of claim 28, wherein the full diameter section of the upper body portion exceeds 70% of a length of the upper body portion and the tapered section extends along less than 30% of the length of the upper body portion.

30. The plunger lift apparatus of claim 21, further comprising a valve cap, wherein the valve cage includes an upper end engaging the plunger body and a lower end engaging the valve cage cap, wherein the valve cage and the valve cap retain the clutch assembly.

31. The plunger lift apparatus of claim 21, wherein the bore and the valve stem extend parallel to a longitudinal axis of the valve cage.

32. The plunger lift apparatus of claim 21, wherein the valve stem defines a valve head and the plunger body defines a valve seat in fluid communication with the flow passage, wherein the valve head is configured to seal with the valve seat so as to block the flow passage when a force overcomes a gripping force applied on the valve stem by the clutch assembly and slides the valve stem towards the plunger body.

33. The bypass valve assembly of claim 4, wherein the valve stem has a predetermined surface roughness of 500 to 550 micro inches.

34. The bypass valve assembly of claim 4, wherein the first opening is elongate and defines at least two ends, wherein the ramp is defined proximal to one of the at least two ends.

35. A bypass valve assembly for a plunger lift apparatus, comprising:

a bypass valve cage defining a bore;

a valve stem disposed at least partially through the bore of the valve cage; and a split bobbin clutch assembly including a split bobbin surrounded by at least one tension band, wherein the split bobbin clutch assembly is disposed around the valve stem and is coupled with the valve cage, and wherein the tension band presses the split bobbin into engagement with the valve stem, wherein the valve cage comprises a sidewall defining a first and second openings therethrough, and wherein the first opening and the second opening define two angular intervals therebetween, wherein the two angular intervals are substantially equal.

36. A clutch assembly for a plunger lift bypass valve, comprising:

a valve stem configured to be disposed at least partially through a bore of a valve cage of the plunger lift bypass valve, the valve stem comprising an outer surface, wherein at least a portion of the outer surface has a predetermined surface roughness of 500 to 550 micro inches;

a split bobbin configured to be disposed around at least a portion of the valve stem; and at least one tension band surrounding the split bobbin and configured to press the split bobbin into engagement with the outer surface of the valve stem.

* * * * *